US005525090A

United States Patent [19]

Halford et al.

[11] Patent Number: 5,525,090

[45] Date of Patent: Jun. 11, 1996

[54] TOY VEHICLE HAVING PIVOTING PINCERS

[75] Inventors: Wayne R. Halford, Hermosa Beach; Steed Sun, San Marino; David McElroy, South Pasadena, all of Calif.

[73] Assignee: Mattel, Inc., El Segundo, Calif.

[21] Appl. No.: 515,342

[22] Filed: Aug. 15, 1995

[51] Int. Cl.[6] ..... A63H 17/00; A63H 17/26

[52] U.S. Cl. ..... 446/465; 446/470; 446/330

[58] Field of Search ..... 446/465, 470, 446/304, 330, 336, 466

[56] References Cited

U.S. PATENT DOCUMENTS

| | | | |
|---|---|---|---|
| D. 305,050 | 12/1989 | Ishizawa . | |
| 4,169,336 | 10/1979 | Kuhn . | |
| 4,170,840 | 10/1979 | Ogawa . | |
| 4,206,564 | 6/1980 | Ogawa . | |
| 4,248,006 | 2/1981 | Jones et al. . | |
| 4,307,533 | 12/1981 | Sims et al. . | |
| 4,469,327 | 9/1984 | Ulrich et al. . | |
| 4,515,571 | 5/1985 | Kozuka et al. | 446/90 |
| 4,529,391 | 7/1985 | Hoshino et al. | 446/356 |
| 4,575,349 | 3/1986 | Piazza et al. | 446/330 |
| 4,576,586 | 3/1986 | Amici et al. | 446/315 |
| 4,578,046 | 3/1986 | Ohno | 446/376 |
| 4,579,541 | 4/1986 | Kulesza et al. | 446/304 |
| 4,586,911 | 5/1986 | Murakami | 446/376 |
| 4,594,071 | 6/1986 | Zaruba et al. | 446/99 |
| 4,629,440 | 12/1986 | McKittrick, Jr. et al. | 446/356 |
| 4,680,018 | 7/1987 | Ohno | 446/376 |
| 4,682,970 | 7/1987 | Dubois et al. | 446/309 |
| 4,685,894 | 8/1987 | Beny et al. | 446/470 X |
| 4,689,033 | 8/1987 | Droller et al. | 446/330 X |
| 4,689,034 | 8/1987 | Dubois et al. | 446/309 |
| 5,052,680 | 10/1991 | Malewicki et al. | 446/465 X |
| 5,334,078 | 8/1994 | Hippely et al. | 446/470 |

FOREIGN PATENT DOCUMENTS

| | | | |
|---|---|---|---|
| 2153242 | 8/1985 | United Kingdom | 446/99 |
| 2155346 | 9/1985 | United Kingdom . | |

OTHER PUBLICATIONS

Playthings Nov. 1985 Issue "Robots Take Control of Boy's Market", pp.56, 57, 60, 61.

*Primary Examiner* Mickey Yu
*Attorney, Agent, or Firm* Roy A. Ekstrand

[57] ABSTRACT

A toy vehicle includes a body supporting a pair of rear wheels and a pivotally secured lower jaw portion supporting a pair of front wheels. The vehicle further includes a pair of pivotally secured pincers movable between a rearward or closed position and a forwardly extending or open position. Each pincer is coupled to a gear portion which in turn is coupled to one side of a two-sided gear rack movable within the vehicle body in response to a pivoting actuator. As the actuator is pivoted, the gear rack is driven forwardly or rearwardly to cause pivotal motion of the pincers. A resilient body is secured to the vehicle body and includes a plurality of flexible tubular tentacles which extend from the resilient body and are coupled to each of the pincers. As a result, the toy vehicle is configured in a relatively standard appearance closed position or a monster-like alternate configuration as the actuator is moved between alternative positions.

13 Claims, 2 Drawing Sheets

TOY VEHICLE HAVING PIVOTING PINCERS

FIELD OF THE INVENTION

This invention relates generally to toy vehicles and particularly to those having alternative configurations.

BACKGROUND OF THE INVENTION

Toy vehicles have proven to be an extremely popular and long lasting toy category. Responding to the continued and ever increasing popularity of such toy vehicle products, practitioners in the art have endeavored to provide a virtually endless array of toy vehicle types. Such toy vehicles have been provided in both unpowered and powered versions. The former usually provides a plurality of rolling wheels upon which the user moves the toy vehicle. The latter typically provides a wind-up spring driven or battery-powered electric drive mechanism which transmits operative power to one or more of the rolling wheels. In addition, toy vehicles have been provided having inertial or flywheel type drive mechanisms. In addition to powered and unpowered variations of toy vehicles, a virtually unlimited array of vehicle appearances have been provided. Such toy vehicles have also been provided in featured versions or types as well as transformable toy vehicles. Featured toy vehicles refers to vehicles having some accessory capability or interactive accessory such as toy vehicles firing weapons, climbing, launching or firing missiles, spinning or turning, or remote control capability. Transformable toy vehicles, on the other hand, refers generally to toy vehicles which undergo dramatic appearance changes by providing a plurality of articulated elements which may be configured to provide distinct appearances.

For example, transformable toy vehicles which may be reconfigured to form a robot or monster have become extremely plentiful in the art.

For example, U.S. Patent Des. 305,050 issued to Ishizawa sets forth a RECONFIGURABLE DOUBLE-HEADED TOY FIGURE having a plurality of articulated elements which alternatively form a double-headed dragon-like monster or a futuristic robot.

U.S. Pat. No. 4,170,840 issued to Ogawa sets forth a TOY VEHICLE DOLL ASSEMBLY including an articulated doll and subcomponent parts capable of forming a vehicle. The doll may be configured to represent a humanoid with removable appendages and a front carriage member supporting a pair of wheels may be removably attached to the legs of the doll while a rear carriage member may be removably attached to the back of the doll body to form a toy vehicle.

U.S. Pat. No. 4,206,564 issued to Ogawa sets forth an ARTICULATED RECONFIGURABLE ROBOT DOLL formed of a plurality of diverse shaped pieces wherein each pair of pieces are joined together by a press fit joint. The pieces that make of the body and limbs of the robot are joined for articulate movement.

U.S. Pat. No. 4,248,006 issued to Jones, et al. sets forth a RECONFIGURABLE MOVING ANIMAL SIMULATING TOY having an upper and lower body section. The lower body section is operatively attachable to the upper body section in a plurality of configurations. A container capable of holding a liquid is included in the upper body section and a compressible bellows and nozzle are operatively connected to the container facilitating the squirting of liquid from the toy.

U.S. Pat. No. 4,307,533 issued to Sims, et al. sets forth an INSECT SIMULATING MOBILE TOY HAVING FLAPPABLE WINGS in which a main body section forming a head and tail section are attached to form an insect body. Two wings are rotatably mounted for disposition on both lateral sides of the main body section. A mechanism is provided to cause simultaneous flapping of all wings.

U.S. Pat. No. 4,529,391 issued to Hoshino, et al. sets forth a TOY HAVING TWO MODES OF LOCOMOTION including a body having a flywheel rotatably mounted therein. A further wheel is also rotatably mounted on the body and a plurality of appendages are mounted upon the body which may be configured alternatively to form a motorcycle or a dinosaur-like creature.

U.S. Pat. No. 4,578,046 issued to Ohno sets forth a REVERSIBLY TRANSFORMABLE TOY BLOCK ASSEMBLY constructed to be reversibly transformed between two entirely different toy types. The block assembly may be constructed to reversibly transform between a toy vehicle or a robot.

U.S. Pat. No. 4,586,911 issued to Murakami sets forth a TRANSFORMABLE TOY VEHICLE capable of being converted to a toy robot.

U.S. Pat. No. 4,680,018 issued to Ohno sets forth a RECONFIGURABLE TOY ASSEMBLY adapted to be reversibly transformed to provide to toy configurations distinct from each other. In its typical form, the reconfigurable toy is constructed to provide a vehicle and a humanoid form.

U.S. Pat. No. 5,052,680 issued to Malewicki, et al. sets forth a TRAILERABLE ROBOT FOR CRUSHING VEHICLES having a mechanical robot including hydraulically operated arms, mandible claws, neck, head and jaw resembling a giant prehistoric reptile. The mechanical robot may be reconfigured to form a trailer-like vehicle.

British Patent 2,153,242A issued to Ohno sets forth a RECONFIGURABLE TOY capable of configuration in a dinosaur form or a robotic humanoid.

British Patent 2,155,346A issued to Ohno sets forth a RECONFIGURABLE TOY AND MECHANISM THEREFOR having a plurality of interconnected members capable of configuration as a reptilian dinosaur-like monster or robot.

Examples of toys and toy vehicle like toys having feature components are found for example in U.S. Pat. No. 4,689,034 issued to Dubois, et al. which sets forth a FIGURE TOY WITH PROJECTILE LAUNCHING MECHANISM; U.S. Pat. No. 4,469,327 issued to Ulrich, et al. which sets forth an AMUSEMENT GAME DEVICE; 4,515,571 issued to Kozuka, et al. which sets forth a MOVING TOY CAPABLE OF BEING NONPERMANENTLY ASSEMBLED; U.S. Pat. No. 4,594,071 issued to Zaruba, et al. which sets forth a COMPOSITE TOY VEHICLE ASSEMBLY; U.S. Pat. No. 4,629,440 issued to McKittrick, Jr. et al. which sets forth an ANIMATED TOY; and U.S. Pat. No. 4,575,349 issued to Piazza, et al. which sets forth a WINGED CREATURE.

Further examples are found in the art which employ additional toy features such as U.S. Pat. No. 4,689,033 issued to Droller, et al. which sets forth a FIGURE TOY WITH RAPIDLY EXTENSIBLE TONGUE having an insect-like creature with a spring-loaded extending tongue; U.S. Pat. No. 4,682,970 issued to Dubois, et al. which sets forth a FIGURE TOY WITH EXTENSIBLE HEAD PORTION having an insect-like body supporting a spring-loaded extensible head and trigger mechanism; and U.S. Pat. No. 4,576,586 issued to Amici, et al. which sets forth a CORD- CLIMBING CREATURE having an insect-like body through which an elongated cord extends together with a pulley apparatus for climbing the cord.

U.S. Pat. No. 4,169,336 issued to Kuhn sets forth an STRETCHABLE FIGURE EXHIBITING SLOW RECOVERY having a skin of elastic film and a filling of a high viscosity material formed in a human like body which exhibits great elongation and slow recovery from stretching.

While the foregoing described prior art devices have, in many instances, improved the art and in some cases enjoyed substantial commercial success, there remains nonetheless a continuing need in the art for evermore improved toy vehicles having interesting configuration variations.

SUMMARY OF THE INVENTION

Accordingly, it is a general object of the present invention to provide an improved toy vehicle. It is a more particular object of the present invention to provide an improved toy vehicle having a novel and unusual alternate configuration mechanism.

In accordance with the present invention, there is provided a toy vehicle comprising: a vehicle body; a pair of pincers pivotally secured to the vehicle body movable between a rearwardly extending closed position and a forwardly extending open position; an actuator movably coupled to the vehicle body; drive means, coupled to the actuator and the pair of pincers, for causing the pair of pincers to pivot between the open and closed positions in response to actuator movement relative to the vehicle body; and a resilient body secured to the vehicle body having a plurality of elongated tube-like tentacles extending from the resilient body to the pincers.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
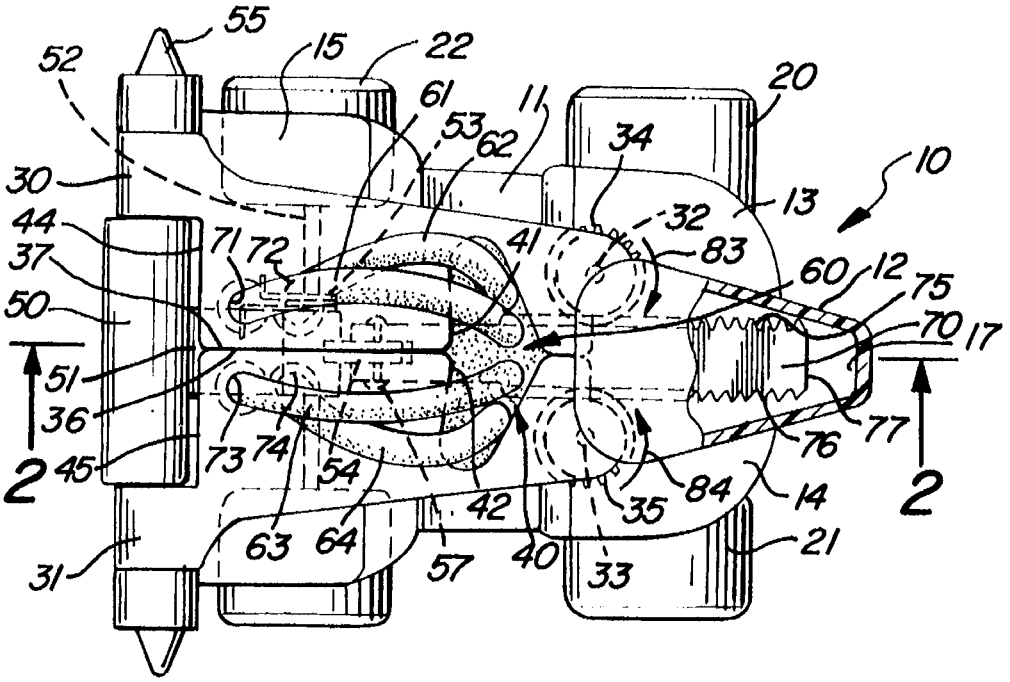
FIG. 1 sets forth a partially sectioned top view of the present invention toy vehicle in the compacted or closed configuration.

FIG. 1 sets forth a top view of a toy vehicle constructed in accordance with the present invention and generally referenced by numeral 10. In the top view of FIG. 1, toy vehicle 10 is shown in its compact or closed position. Thus, toy vehicle 10 includes a body 11 having a forward cab portion 12 which in turn defines an interior cavity 17. Body 11 further defines a pair of front fenders 13 and 14 and a pair of rear fenders 15 and 16. A pair of rear wheels 22 and 23 are supported upon body 11 beneath fenders 15 and 16 respectively by a rear axle 52. As is better seen in FIG. 2, a pair of front wheels 20 and 21 are supported by a lower jaw 90 beneath front fenders 13 and 14 respectively.

Toy vehicle 10 further includes a pair of elongated pincers 30 and 31 defining outwardly extending points 55 and 56 respectively. Pincers 30 and 31 further define mirror image recesses 44 and 45 and interior edges 36 and 37 respectively. In addition, pincer 30 defines a notch 41 while pincer 31 defines a mirror image notch 42. In the position shown in FIG. 1 in which pincers 30 and 31 are in their compacted or closed position, notches 41 and 42 combine to form an elongated slot 40. Pincer 31 includes a gear 34 at the forward end thereof while pincer 31 includes a gear 35 at the forward end thereof. Gear 34 and pincer 30 are pivotally secured to body 11 at a pivotal attachment 32. Correspondingly, gear 35 and pincer 31 are pivotally secured to body 11 at a pivotal attachment 33. Thus, pincers 30 and 31 are pivotable about pivotal attachments 32 and 33 between the closed position shown in FIG. 1 and the open position shown in FIG. 3 using the operative mechanism described below.

Pincer 30 defines a pair of apertures 71 and 72 while pincer 31 defines a pair of apertures 73 and 74. A resilient body 60 formed of a rubber or resilient plastic material or the like is positioned upon body 11 beneath pincers 30 and 31 as is better seen in FIG. 2. Resilient body 60 includes a pair of tubular tentacles 61 and 62 extending through notch 41 and apertures 71 and 72 respectively. Resilient body 60 also includes a second pair of tubular tentacles 63 and 64 which extend through notch 42 and apertures 73 and 74 respectively of pincer 31. In its preferred form, resilient body 60 is sculpted to include exterior features suggestive of an octopus or squid-like creature having tubular tentacles also suitably sculpted.

Toy vehicle 10 further includes an elongated two-side gear rack 70 having opposed gear tooth arrays 75 and 76 extending outwardly from each side thereof. Gear rack 70 defines a frontal end 77 received within interior cavity 17 of cab portion 12. As is better seen in FIG. 2, the remaining end of gear rack 70 is pivotally coupled to an arm 54 by a pin 57. An actuator 50 having a generally cylindrical shape is received within recesses 44 and 45 and is supported by a forwardly extending arm 51. Arm 51 is pivotally secured to body 11 by rear axle 52 and is further coupled to arm 54. In its preferred form, arm 54 and arm 51 together with actuator 50 are fabricated of a single integral member all of which is pivotally attached to rear axle 52.

Gear teeth 75 and 76 of gear rack 70 engage gears 34 and 35 respectively of pincers 30 and 31. A return spring 53 is coupled between body 11 and arm 51 of actuator 50 to urge actuator 50 to the position shown in FIGS. 1 and 2 which is better seen in FIG. 2 corresponds to the raised position of actuator 50. With actuator 50 maintained in the raised position shown in FIGS. 1 and 2 by spring 53, gear rack 70 is maintained in its forwardmost position. Correspondingly, with gear rack 70 in its forwardmost position, gears 34 and 35 together with pincers 30 and 31 are pivoted to the closed position shown in FIGS. 1 and 2.

In this position, toy FIG. 10 may be utilized by the child user in accordance with conventional play patterns in which toy vehicle 10 is rolled about a play surface upon wheels 20 through 22.

Figure 2:
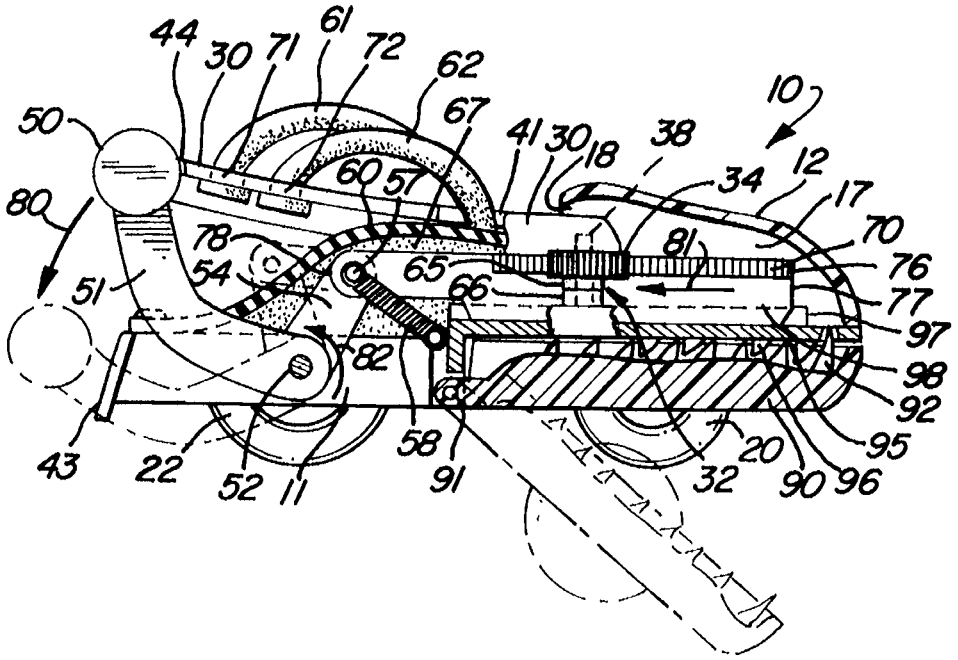
FIG. 2 sets forth a section view of the present invention toy vehicle taken along section lines 2—2 in FIG. 1.

FIG. 2 sets forth a section view of toy vehicle 10 taken along section lines 2—2 in FIG. 1. Toy vehicle 10 includes a body 11 having a rear axle 52 supported thereon by conventional fabrication techniques (not shown) which in turn supports rear wheels 22 and 23 (the latter seen in FIG. 1). Body 11 further includes a frontal cab portion 12 which in turn defines an interior cavity 17. Body 11 also defines an upper jaw 95 having a plurality of downwardly extending upper teeth 96 formed therein. A lower jaw 90 supports a plurality of upwardly extending lower teeth 92 and is pivotally secured to body 11 at a pivotal attachment 91. Body 11 further defines an upwardly extending cylindrical boss 66 which receives an upwardly extending shaft 38. Gear 34 is received upon shaft 38 and is joined to pincer 30. Pincer 30 and gear 34 are preferably integrally formed. Gear 34 defines a downwardly extending spacer 65 which rests upon boss 66 and which positions gear 34 in alignment with gear teeth 75 (seen in FIG. 1) of gear rack 70.

Gear rack 70 is a two-sided gear rack having gear teeth 75 and 76 (the former seen in FIG. 1) extending along opposed sides thereof. Gear rack 70 is received within a guide 97 formed within interior cavity 17 of cab 12 upon body 11. Gear rack 70 also defines a frontal end 77 and an interior end 78.

An arm 51 is pivotally secured to body 11 at rear axle 52 and includes an upwardly extending arm 54 and an actuator 50. In its preferred form, arm 51, actuator 50 and arm 54 are integrally formed of a single molded component and thus pivotable about axle 52. Arm 54 is pivotally secured to end 78 of gear rack 70 by a pin 57. A return spring 58 is coupled between body 11 and pin 57 to provide a spring force urging arm 54 in the clockwise direction and urging gear rack 70 in the forward direction. Thus, spring 58 cooperates with spring 53 (seen in FIG. 1) in urging actuator 50 and gear rack 70 toward the closed position shown in FIGS. 1 and 2. Body 11 further defines a downwardly extending rear stop 43, the operation of which is set forth below in greater detail. Suffice it note here that stop 43 limits the pivotal motion of toy vehicle 10 upon rear wheels 22 and 23 when actuator 50 is depressed in the manner also described below in greater detail.

Toy vehicle 10 includes a resilient body 60 defining an interior cavity 67 and secured upon body 11 beneath pincers 30 and 31 (the latter seen in FIG. 1). As described above, pincer 30 defines a notch 41 through which a pair of flexible tube-shaped tentacles 61 and 62 of body 60 extend. As is also described above, pincer 30 defines a pair of apertures 71 and 72 which receive the opposite ends of tentacles 61 and 62. Cab 12 further defines a rear aperture 18 which receives the frontal portions of pincers 30 and 31 (the latter seen in FIG. 1).

In operation and with simultaneous reference to FIGS. 1 and 2 in which toy vehicle 10 is shown in its compacted or closed position, spring 53 and spring 58 cooperate to urge actuator 50 to its uppermost position and to urge gear rack 70 to its forwardmost position. This, in turn, urges pincers 30 and 31 to the closed position shown in FIGS. 1 and 2. To operate the present invention toy vehicle in an alternate configuration, the user simply forces actuator 50 downwardly in a pivotal motion in the direction indicated by arrow 80. Initially, toy vehicle 10 pivots to lower the rear portion and raise the frontal portion of the toy vehicle in a pivoting motion about wheels 22 and 23. This pivotal motion of the entire toy vehicle continues until stop 43 contacts the play surface upon which the toy vehicle is resting. At that point, further pivotal motion of the toy vehicle as a whole is precluded by stop 43. The continued downward pressure upon actuator 50 in the direction indicated by arrow 80, however, overcomes the combined forces of springs 53 and 58 and pivots arm 51 in the direction of arrow 80 about rear axle 52. The pivotal motion of arm 51 about rear axle 52 causes a corresponding pivotal motion of arm 54 in the direction indicated by arrow 82. As arm 54 pivots, gear rack 70 is drawn rearwardly toward the dashed-line position shown in FIG. 2 in the direction of arrow 81. The rearward motion of gear rack 70 causes a simultaneous rotation of gears 34 and 35 in the directions indicated by arrows 83 and 84 in FIG. 1. Because gears 34 and 35 are integrally formed with or secured directly to pincers 30 and 31, the continued rearward motion of gear rack 70 and rotation of gears 34 and 35 pivots pincers 30 and 31 outwardly in a separating and forwardly pivoting direction. As actuator 50 continues to be forced downwardly, the rearward motion of gear rack 70 continues as does the pivotal motion of gears 34 and 35 and pincers 30 and 31 until the pincers assume the extended position shown in FIG. 3. During this motion, tentacles 61 through 64 are drawn forwardly with pincers 30 and 31 and are stretched to an extended length. In addition and as is better seen in FIG. 3 and described below, the pivoting of pincers 30 and 31 to the forwardly extended position exposes a substantial portion of resilient body 60 giving toy vehicle 10 a monster-like configuration and appearance.

In addition to the motion of pincers 30 and 31 as actuator 50 is forced downwardly in the direction of arrow 80, the upward motion of the frontal portion of toy vehicle 10 as the vehicle pivots about rear wheels 22 and 23 also raises upper jaw 95 and allows lower jaw 90 to open downwardly to the dashed-line position. This downward pivotal motion of lower jaw 90 and upward pivotal motion of upper jaw 95 as the toy vehicle is pivoted upwardly about its rear wheels exposes the upper and lower pluralities of teeth and configures the toy vehicle in an open mouth configuration. This open mouth configuration further enhances the fierce and monster-like appearance of the toy vehicle.

Figure 3:
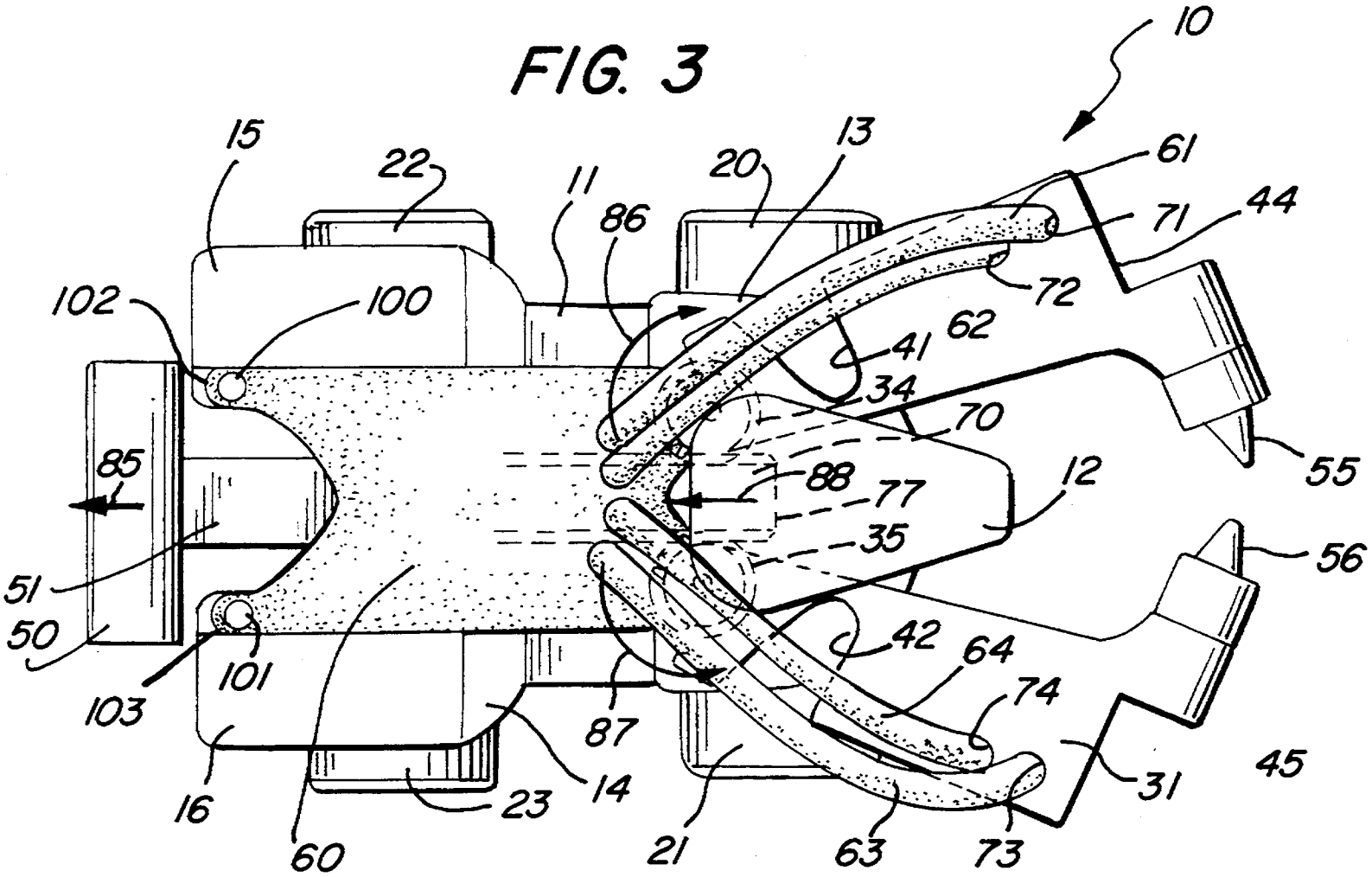
FIG. 3 sets forth a top view of the present invention toy vehicle in its open or expanded configuration.

FIG. 3 sets forth a top view of the present invention toy vehicle in its open or extended position following the above-described operation as actuator 50 is pressed downwardly. As described above, toy vehicle 10 includes a body 11 having a pair of front fenders 13 and 14 and a pair of rear fenders 15 and 16. Body 11 further includes a cab 12 extending forwardly from the frontal portion of body 11. A resilient body 60 includes end portions 102 and 103 secured to body 11 by a pair of attachment posts 100 and 101 respectively. Toy vehicle 10 further includes a pair of pincers 30 and 31 pivotally secured to body 11 in the manner set forth above. Pincers 30 and 31 further define a pair of integrally formed gears 34 and 35 which engage an elongated two-sided gear rack 70 extending between gears 34 and 35. In the manner described below in FIGS. 1 and 2 in greater detail, gear rack 70 is coupled to a rearwardly extending arm 51 which in turn supports an actuator 50. Thus, gear rack 70 simultaneously engages gears 34 and 35 and thus motion of gear rack 70 forwardly and rearwardly produces corresponding rotations of gears 34 and 35 together with pincers 30 and 31.

Resilient body 60 further includes a pair of tubular flexible tentacles 61 and 62 extending upwardly from the forward portion of resilient body 60 and passing through apertures 71 and 72 respectively formed in pincer 30. Resilient body 60 further includes a second pair of flexible tubular tentacles 63 and 64 extending from resilient body 60 through apertures 73 and 74 respectively formed in pincer 31.

In the position shown in FIG. 3, the above-described motion of actuator 50 causing actuator 50 to pivot arm 51 downwardly draws gear rack 70 rearwardly in the direction indicated by arrow 88. The rearward motion of gear rack 70 rotates gears 34 and 35 in the directions indicated by arrows 86 and 87. Pincers 30 and 31 are correspondingly rotated as gears 34 and 35 rotate to pivot pincers 30 and 31 forwardly to the extended position shown in FIG. 3. This position is maintained so long as actuator 50 remains depressed. However, once actuator 50 is released, the return force provided by springs 53 and 58 (seen in FIGS. 1 and 2 respectively) drives gear rack 70 forwardly causing gears 34 and 35 to pivot in the opposite direction of arrows 86 and 87 respectively thereby pivoting pincers 30 and 31 rearwardly to reassume the closed position shown in FIGS. 1 and 2.

In accordance with an important aspect of the present invention, the dramatic reconfiguration of toy vehicle 10 is achieved through a very simple manipulation of a single actuator and is thus attainable by even the youngest of children playing with such toy vehicles. In further accordance with the present invention, the exposure of resilient body 60 and stretching of tentacles 61 through 64 as pincers 30 and 31 rotate forwardly to their extended positions provides a dramatic visual effect giving the toy vehicle an interesting monster-like reconfiguration. The resilient flexible character of resilient body 60 and tentacles 61 through 64 further enhances this dramatic effect.

What has been shown is a novel toy vehicle having a pair of pivoting pincers together with a resilient body coupled thereto which facilitates a dramatic reconfiguration of the toy vehicle in response to a simple motion of a single actuator mechanism. The operative mechanism is provided using a two-sided gear rack which engages a pair of integrally formed gears supported by each pincer thereby providing a simple easy to assemble mechanism which is able to withstand a substantial amount of stress and abuse.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a vehicle body;

a pair of pincers pivotally secured to said vehicle body movable between a rearwardly extending closed position and a forwardly extending open position;

an actuator movably coupled to said vehicle body;

drive means, coupled to said actuator and said pair of pincers, for causing said pair of pincers to pivot between said open and closed positions in response to actuator movement relative to said vehicle body; and a resilient body secured to said vehicle body having a plurality of elongated tube-like tentacles extending from said resilient body to said pincers.

2. A toy vehicle as set forth in claim 1 wherein said drive means includes:

a gear rack coupled to said actuator; and a pair of gears each secured to one of said pincers engaging said gear rack.

3. A toy vehicle as set forth in claim 2 wherein said gear rack passes between said gears in said pair of gears.

4. A toy vehicle as set forth in claim 3 wherein said gear rack defines a pair of oppositely facing arrays of gear teeth each engaging one of said gears in said pair of gears.

5. A toy vehicle as set forth in claim 4 wherein said drive means includes a return spring urging said pincers toward said closed position.

6. A toy vehicle as set forth in claim 1 wherein said drive means includes a return spring urging said pincers toward said closed position.

7. A toy vehicle as set forth in claim 1 wherein said vehicle body further includes:

an upper jaw having a plurality of downwardly extending teeth; and a lower jaw having a plurality of upwardly extending teeth, said lower jaw being pivotally coupled to said upper jaw.

8. A toy vehicle as set forth in claim 7 wherein said drive means includes:

a gear rack coupled to said actuator; and a pair of gears each secured to one of said pincers engaging said gear rack.

9. A toy vehicle as set forth in claim 8 wherein said gear rack passes between said gears in said pair of gears.

10. A toy vehicle as set forth in claim 9 wherein said gear rack defines a pair of oppositely facing arrays of gear teeth each engaging one of said gears in said pair of gears.

11. A toy vehicle as set forth in claim 10 wherein said drive means includes a return spring urging said pincers toward said closed position.

12. A toy vehicle comprising:

a vehicle body having rear wheels;

a gear rack having first and second rows of outwardly extending gear teeth; p1 actuator means for moving said gear rack relative to said vehicle body;

first and second gears rotatably supported on said vehicle body engaging said first and second rows of gear teeth respectively;

first and second pincers secured to said first and second gears respectively and pivotable therewith;

an upper jaw formed on said vehicle body; and a lower jaw having front wheels pivotally coupled to said vehicle body movable between a closed position against said upper jaw and an open position pivoted from said upper jaw, whereby manipulation of said actuator means pivots said pincers relative to said vehicle body by moving said gear rack between said first and second gears and pivots said vehicle about said rear wheels to raise said upper jaw and allow said lower jaw to pivot away from said upper jaw.

13. A toy vehicle as set forth in claim 12 further including a resilient body secured to said vehicle body having elongated flexible resilient members coupled to said pincers.

* * * * *